US009657996B2

(12) United States Patent
Okazawa et al.

(10) Patent No.: US 9,657,996 B2
(45) Date of Patent: May 23, 2017

(54) FLAT TUBE HEAT EXCHANGER AND OUTDOOR UNIT OF AIR-CONDITIONING APPARATUS INCLUDING THE HEAT EXCHANGER

(71) Applicant: Mitsubishi Electric Corporation, Tokyo (JP)

(72) Inventors: Hiroki Okazawa, Tokyo (JP); Yudai Morikawa, Tokyo (JP); Hiroya Ikuta, Tokyo (JP); Takashi Nakajima, Tokyo (JP); Hiroki Toyoshima, Tokyo (JP); Takashi Kato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 196 days.

(21) Appl. No.: 14/442,464

(22) PCT Filed: Jun. 21, 2013

(86) PCT No.: PCT/JP2013/067049
§ 371 (c)(1),
(2) Date: May 13, 2015

(87) PCT Pub. No.: WO2014/091782
PCT Pub. Date: Jun. 19, 2014

(65) Prior Publication Data

US 2016/0003547 A1 Jan. 7, 2016

(30) Foreign Application Priority Data

Dec. 10, 2012 (WO) ..... PCT/JP2012/081927

(51) Int. Cl.
*F28F 1/10* (2006.01)
*F28D 7/00* (2006.01)
(Continued)

(52) U.S. Cl.
CPC ..... *F28D 7/0066* (2013.01); *F24F 1/14* (2013.01); *F28D 1/0435* (2013.01);
(Continued)

(58) Field of Classification Search
CPC .... F28D 7/0066; F28D 1/0455; F28D 1/0478; F28F 1/14; F28F 1/32; F28F 2215/12
(Continued)

(56) References Cited

U.S. PATENT DOCUMENTS 6,105,665 A * 8/2000 Ghiani ..... F28D 1/0333 165/153
8,037,929 B2 * 10/2011 Higashiyama ..... F25B 39/02 165/152
(Continued)

FOREIGN PATENT DOCUMENTS

JP S56-58185 U 5/1981
JP H02-154992 A 6/1990
(Continued)

OTHER PUBLICATIONS

Extended European Search Report issued Oct. 13, 2016 in the corresponding EP Patent application No. 13863071.0.
(Continued)

*Primary Examiner* — Davis Hwu
(74) *Attorney, Agent, or Firm* — Posz Law Group, PLC

(57) ABSTRACT

A flat tube heat exchange apparatus that has flat tubes arranged at a regular pitch in the step direction which is orthogonal to the row direction of fins. If the step direction pitch of the flat tubes is defined as Dp, the coefficient of Dp is k, and if 0<k<0.5 or 0.5<k<1, the distance between a fin end at one side in the step direction of the fins, and the center of a flat tube in the thickness direction is k·Dp, and the distance between a fin end at the other side in the step
(Continued)

direction of the fins, and the center of a flat tube in the thickness direction is (1−k)·Dp.

7 Claims, 16 Drawing Sheets

(51) Int. Cl.
*F28F 1/32* (2006.01)
*F28D 1/04* (2006.01)
*F28D 1/047* (2006.01)
*F24F 1/14* (2011.01)

(52) U.S. Cl.
CPC ..... *F28D 1/0478* (2013.01); *F28F 1/32* (2013.01); *F28F 2215/12* (2013.01)

(58) Field of Classification Search
USPC ..... 165/172
See application file for complete search history.

(56) References Cited

U.S. PATENT DOCUMENTS

| | | | | |
|---|---|---|---|---|
| 2004/0016535 | A1* | 1/2004 | Shimanuki ..... | F24F 13/222 165/172 |
| 2004/0226705 | A1* | 11/2004 | Hiyama ..... | F28F 9/0224 165/172 |

FOREIGN PATENT DOCUMENTS

| | | | |
|---|---|---|---|
| JP | H11-159984 | A | 6/1999 |
| JP | 2004-205124 | A | 7/2004 |
| JP | 2004-325044 | A | 11/2004 |
| JP | 2008-121921 | A | 5/2008 |
| JP | 2009-257741 | A | 11/2009 |
| JP | 2010-054060 | A | 3/2010 |
| JP | 4984836 | B2 | 5/2012 |

OTHER PUBLICATIONS

Office Action dated Jun. 30, 2016 in the corresponding CN Patent application No. 201380062374.X (and English translation).
Office Action mailed Aug. 25, 2015 issued in corresponding JP patent application No. 2014-551907 (and English translation).
International Search Report of the International Searching Authority mailed Aug. 27, 2013 for the corresponding international application No. PCT/JP2013/067049 (and English translation).
Office Action issued Dec. 22, 2015 in the corresponding JP application No. 2014-551907 (with English translation).
Office Action dated Jan. 20, 2017 in the corresponding CN Patent application No. 201380062374.X (and English translation).

* cited by examiner (a)

(b)

(a)

(b)

(a)

(b)

(a)

(b)

(a) ODD-NUMBERED ROW (b) EVEN-NUMBERED ROW

FLAT TUBE HEAT EXCHANGER AND OUTDOOR UNIT OF AIR-CONDITIONING APPARATUS INCLUDING THE HEAT EXCHANGER

CROSS REFERENCE TO RELATED APPLICATION

This application is a U.S. national stage application of International Application No. PCT/JP2013/067049 filed on Jun. 21, 2013, which claims priority to International Application No. PCT/JP2012/081927 filed on Dec. 10, 2012, the disclosures of which are incorporated herein by reference.

TECHNICAL FIELD

The present invention relates to a fin tube heat exchanger to be used as a heat exchanger of an air-conditioning apparatus, a refrigerating machine, or a hot-water supplying unit, and to an outdoor unit of an air-conditioning apparatus including the fin tube heat exchanger. The present invention particularly relates to a flat tube heat exchanger in which flat heat transfer tubes are arranged in a staggered pattern and to an outdoor unit of an air-conditioning apparatus including the fin tube heat exchanger.

BACKGROUND ART

Regarding fin-and-tube heat exchangers, tubes having circular cross sections and flat tubes of rounded rectangular shapes having high aspect ratios in cross section are known shapes of heat transfer tubes. In this specification, a heat exchanger using circular tubes will be referred to as a "circular tube heat exchanger" and a heat exchanger using flat tubes will be referred to as a "flat tube heat exchanger."

To enhance the heat transmission performance of a heat exchanger, heat transfer tubes are arranged in a staggered pattern relative to fins (hereinafter referred to as a "staggered pattern"). In the circular tube heat exchanger, two rows of circular tubes are formed as one unit, and thus, the staggered pattern can be easily obtained. In the flat tube heat exchanger, however, flat tubes are inserted into fins, or slits of the fins are inserted into outer peripheral portions of flat tubes. To ease fabrication, the insertion is performed per row. Thus, in the flat tube heat exchanger, the staggered pattern is obtained by disposing a plurality of rows of heat exchangers in which flat tubes are disposed in units of rows, as described in, for example, Patent Literature 1.

CITATION LIST

Patent Literature

Patent Literature 1: Japanese Patent No. 4984836

SUMMARY OF INVENTION

Technical Problem

In the case of disposing a plurality of rows of flat tube heat exchangers of the same shape, a staggered pattern of flat tubes exhibiting excellent heat transfer characteristics causes misalignment of the fin ends of the rows of flat tube heat exchangers (i.e., causes uneven lengths of the fins). Consequently, projections are formed, which can cause an unnecessary increase in the required installation space of the flat tube heat exchangers. On the other hand, alignment of the fin ends disadvantageously leads to a lattice pattern (hereinafter referred to as a "grid pattern") whose heat transfer characteristics are inferior to those of a staggered pattern.

The present invention has been made in order to solve such disadvantages as described above. An object of the invention is to obtain flat tube heat exchangers which have a staggered pattern and aligned fin ends even with a configuration where a plurality of rows of flat tube heat exchangers of the same shape are disposed, and to obtain an outdoor unit of an air-conditioning apparatus including such flat tube heat exchangers.

Solution to Problem

An outdoor unit of an air-conditioning apparatus according to the present invention includes a plurality of single-row flat tube heat exchangers that are coupled to each other. Each of the single-row flat tube heat exchangers includes: flat tubes each having a rounded rectangular shape with a high aspect ratio in cross section, the flat tubes allowing a heat exchange medium to flow therein; and a plurality of plate-shaped fins in which the flat tubes in a state of being bent into U shapes having hairpin corners are inserted, the fins being brazed to the flat tubes in a direction perpendicular to the flat tubes, wherein in the flat tube heat exchangers, the flat tubes are arranged at a predetermined pitch in a stage direction orthogonal to a row direction of the fins, a distance between fin ends at one side in the stage direction of the fins and a center in a thickness direction of the flat tubes is $k \cdot Dp$ and a distance between fin ends at the other end in the stage direction of the fins and the center in the thickness direction of the flat tubes is $(1-k) \cdot Dp$, where Dp is a pitch of the flat tubes in the stage direction and k is a coefficient of Dp, and either $0<k<0.5$ or $0.5<k<1$, an odd-numbered one of the single-row flat tube heat exchangers is disposed in opposite orientation with respect to the stage direction to an even-numbered one of the single-row flat tube heat exchangers with regard to an air flow direction, and upper and lower ends of the odd-numbered one of the single-row flat tube heat exchangers are aligned with upper and lower ends of the even-numbered one of the single-row flat tube heat exchangers.

Advantageous Effects of Invention

In the outdoor unit of the air-conditioning apparatus of the invention, the distance between fin ends at one side in the stage direction of the fins and the center in the thickness direction of the flat tubes is $k \cdot Dp$ and the distance between fin ends at the other end in the stage direction of the fins and the center in the thickness direction of the flat tubes is $(1-k) \cdot Dp$, where Dp is a pitch of the flat tubes in the stage direction and k is a coefficient of Dp, and either $0<k<0.5$ or $0.5<k<1$, and the first row of the flat tubes is disposed at the side opposite to the second row of the flat tubes in the stage direction. Thus, the fin ends of the odd-numbered row of the flat tube heat exchangers and the even-numbered row of the heat exchangers can be aligned, and the pattern formed by the flat tubes can resemble a staggered pattern, thereby enhancing heat transmission performance.

Thus, according to the present invention, even with a configuration in which a plurality of rows of single-row flat tube heat exchangers of the same shape are disposed, an outdoor unit of an air-conditioning apparatus in which a staggered pattern can be formed and the locations of the fin ends are not misaligned can be obtained.

DESCRIPTION OF EMBODIMENTS

A flat tube heat exchanger according to Embodiment of the present invention will be described with reference to the drawings. Attached drawings including FIG. 1 are schematic illustrations, and a dimensional relationship among components may differ from that of actual components.

Figure 1:
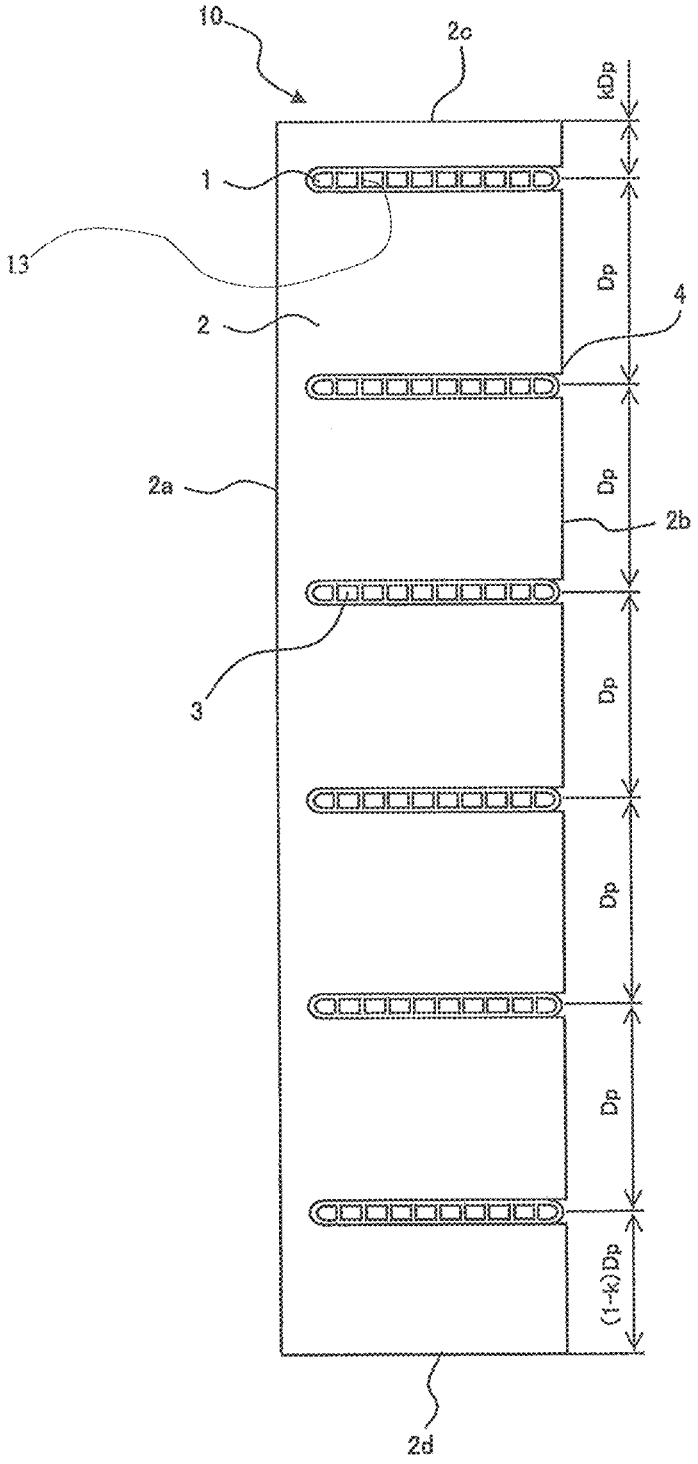
FIG. 1 is a front view illustrating a single-row flat tube heat exchanger (a flat tube heat exchanger row) constituting Embodiment of the present invention.

As illustrated in FIG. 1, each of single-row flat tube heat exchangers (flat tube heat exchanger rows) 10 constituting flat tube heat exchangers of Embodiment includes flat tubes 1, which are heat transfer tubes, and plate-shaped fins 2. Each of the flat tubes 1 is in the shape of a rounded rectangle having a high aspect ratio in cross section, and includes at least one (10 in the illustrated example) channel 3 in which heat exchange medium flows. The heat exchange medium can be a fluid such as water, refrigerant, or brine, for example.

The flat tubes 1 are hollow metal tubes made of, for example, aluminum having a high thermal conductivity, and each include a plurality of partitions 13. The partitions 13 are provided in order to increase the pressure capacity of the flat tubes 1 because of a high gauge pressure on the order of MPa of refrigerant flowing in the flat tubes 1. As illustrated in FIG. 1, a plurality (six in this example) of stages of flat tubes 1 are arranged side by side along the stages of the plate-shaped fins 2 (that is, in the vertical direction in FIG. 1, i.e., the longitudinal direction of the fins 2).

In the case of using the flat tube heat exchanger 10 for an outdoor unit of an air-conditioning apparatus that can perform cooling and heating operations, the flat tube heat exchanger 10 serves as a condenser in the cooling operation and as an evaporator in the heating operation. In the case of using the flat tube heat exchanger 10 as an evaporator, the temperature of the flat tube heat exchanger 10 is lower than an outdoor air temperature, and steam in the outdoor air is condensed so that water drops are attached to the flat tubes 1 and the fins 2. To remove the water drops, the fins 2 need a drainage path.

In FIG. 1, the left ends of the flat tubes 1 are located to the right of the left ends of the fins 2. Water drops attached to the flat tubes 1 and the fins 2 flow in the direction of gravity along the fins between the left ends of the flat tubes 1 and the left ends of the fins 2 and are drained to the outside of the outdoor unit. Thus, in the case of using the flat tube heat exchanger 10 for an outdoor unit of an air-conditioning apparatus that can perform cooling and heating operations, the left ends of the flat tubes 1 need to be located to the right of the left ends of the fins 2 or the right ends of the flat tubes 1 need to be located to the left of the right ends of the fins 2. At each of the left and right ends, the fin 2 may be wider than the flat tubes 1. Such a flat tube heat exchanger 10 will be hereinafter referred to as a fin-and-tube flat tube heat exchanger. In FIG. 1, Dp denotes a pitch between the flat tubes 1 arranged along a plurality of stages, and k denotes a coefficient.

Figure 2:
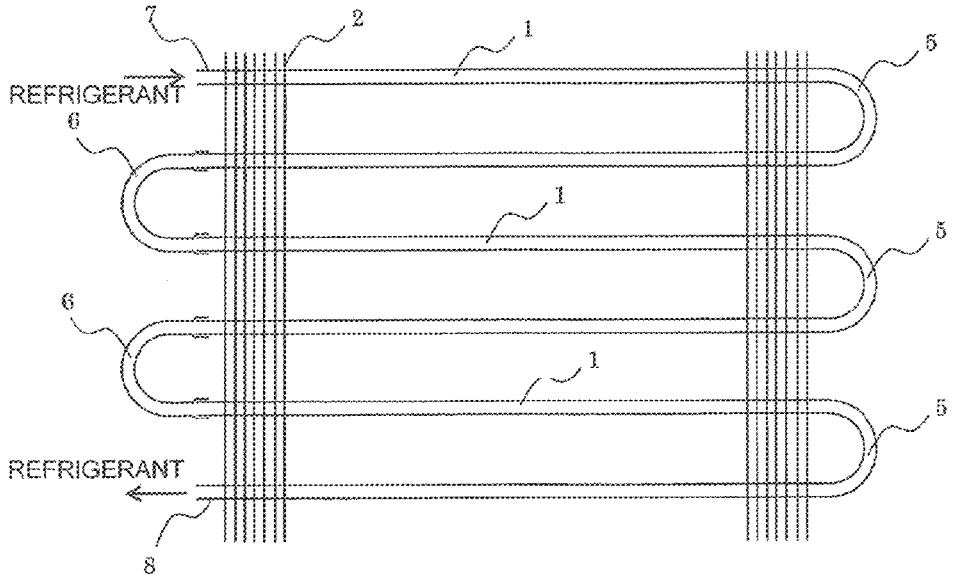
FIGS. 2(*a*) and 2(*b*) illustrate two examples of flat tubes, fins, hairpin corners, and U-bends of the flat tube heat exchanger.
Figure 2:
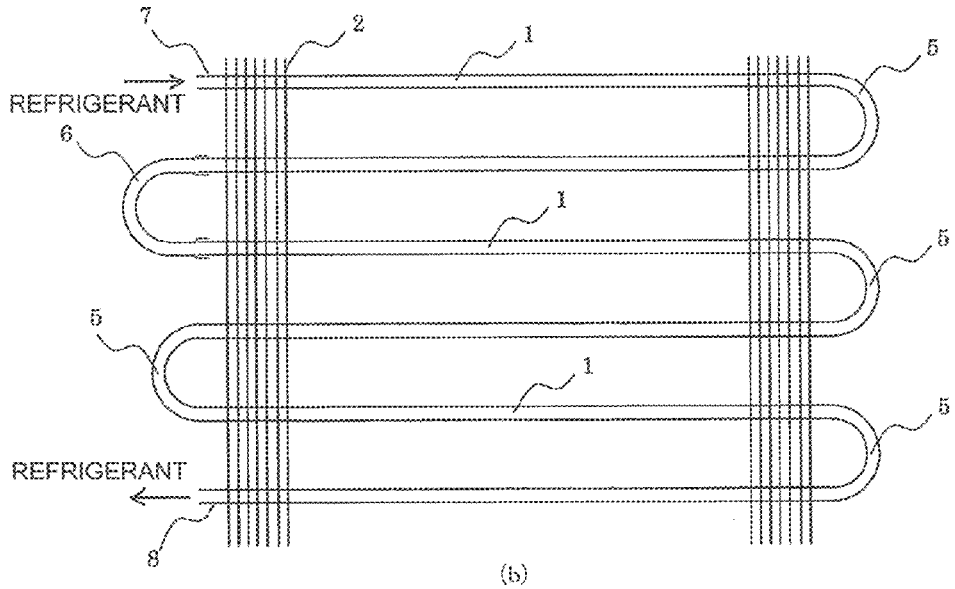
Figure 3:
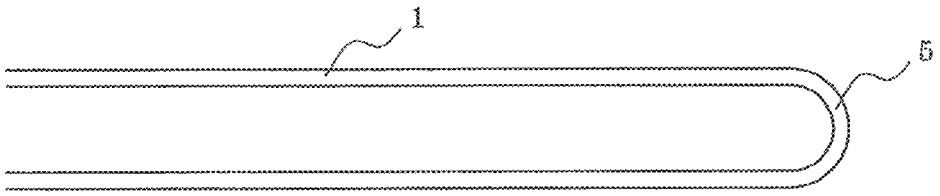
FIG. 3 is a front view of a flat tube for use in the flat tube heat exchanger of Embodiment of the present invention.

As illustrated in FIG. 2(*a*), a plurality of rows of plate-shaped fins 2 are arranged at a predetermined pitch (a fin pitch) and form a right angle with the axial direction of the flat tubes 1. In FIGS. 2(*a*) and 2(*b*), part of the fins 2 is not shown. The fins 2 are made of a metal plate made of, for example, aluminum or copper having a high thermal conductivity. As illustrated in FIG. 1, each of the fins 2 has a rectangular shape composed of longer sides 2*a* and 2*b* and shorter sides 2*c* and 2*d*. The flat tubes 1 are inserted into slits 4 formed in the edge of the longer side 2*b* at one side of the fins 2. The slits 4 are evenly spaced from each other in the fins 2. As illustrated in FIG. 3, each of the flat tubes 1 is bent in an U-shape having a hairpin corner 5. In this state, the flat tubes 1 are respectively inserted into the slits 4 of the fins 2 so that the fins 2 are arranged at a predetermined fin pitch in the flat tubes 1. Then, the flat tubes 1 and the opposed portions of the slits 4 are brazed, thereby joining the flat tubes 1 and the fins 2 to each other to form a single unit. Thereafter, U-bends 6, which are junction tubes each including a single channel, are connected to the ends of the flat tubes 1 so that the stages of the flat tubes 1 are joined. The flat tubes 1 are joined to the U-bends 6 by, for example, brazing. Then, as illustrated in FIG. 2, for example, the single-row flat tube heat exchanger (the flat tube heat exchanger row) 10 is formed so as to enable refrigerant to pass from the flat tubes 1 at a refrigerant inlet 7 to the flat tubes 1 at a refrigerant outlet 8. Although not shown, the refrigerant inlet 7 and the refrigerant outlet 8 may be connected to a header or a distributor.

In the example of FIG. 2(*a*), three flat tubes 1 each having one hairpin corner 5 are connected to each other with two U-bends 6 so as to constitute the single-row flat tube heat exchanger 10. However, the present invention is not limited to this example. As illustrated in FIG. 2(*b*), flat tubes 1 each having one hairpin corner 5 and flat tubes 1 each having two or more hairpin corners 5 may be connected to each other with the U-bends 6 so as to constitute the single-row flat tube heat exchanger 10.

In the single-row flat tube heat exchanger 10 (the flat tube heat exchanger row 10), a heat exchange medium flows in the channel 3 of the flat tubes 1, and a heat exchange target medium (e.g., fluid such as air or water) passes through gaps between the fins 2 in a direction orthogonal to the axial direction of the flat tubes 1, thereby performing heat exchange.

In the single-row flat tube heat exchanger (the flat tube heat exchanger row) 10, the distance between the fin ends (the fin upper ends in FIG. 1) 2*c* at one end in the stage direction of fins 2 and the center in the thickness direction of the flat tubes 1 is k·Dp, and the distance between the fin ends (the fin lower ends in FIG. 1) 2*d* at the other end in the stage direction of the fins 2 and the center in the thickness direction of the flat tubes 1 is (1−k)·Dp, where Dp is a pitch (a stage pitch) in the state direction of the flat tubes 1 orthogonal to the row direction of the fins 2, k is the coefficient of Dp, and either $0 \leq k \leq 0.5$ or $0.5 \leq k \leq 1$.

Thus, the flat tube heat exchanger 10 is asymmetric with respect to a horizontal line in the arrangement of the flat tubes 1 in the stage direction.

Figure 4:
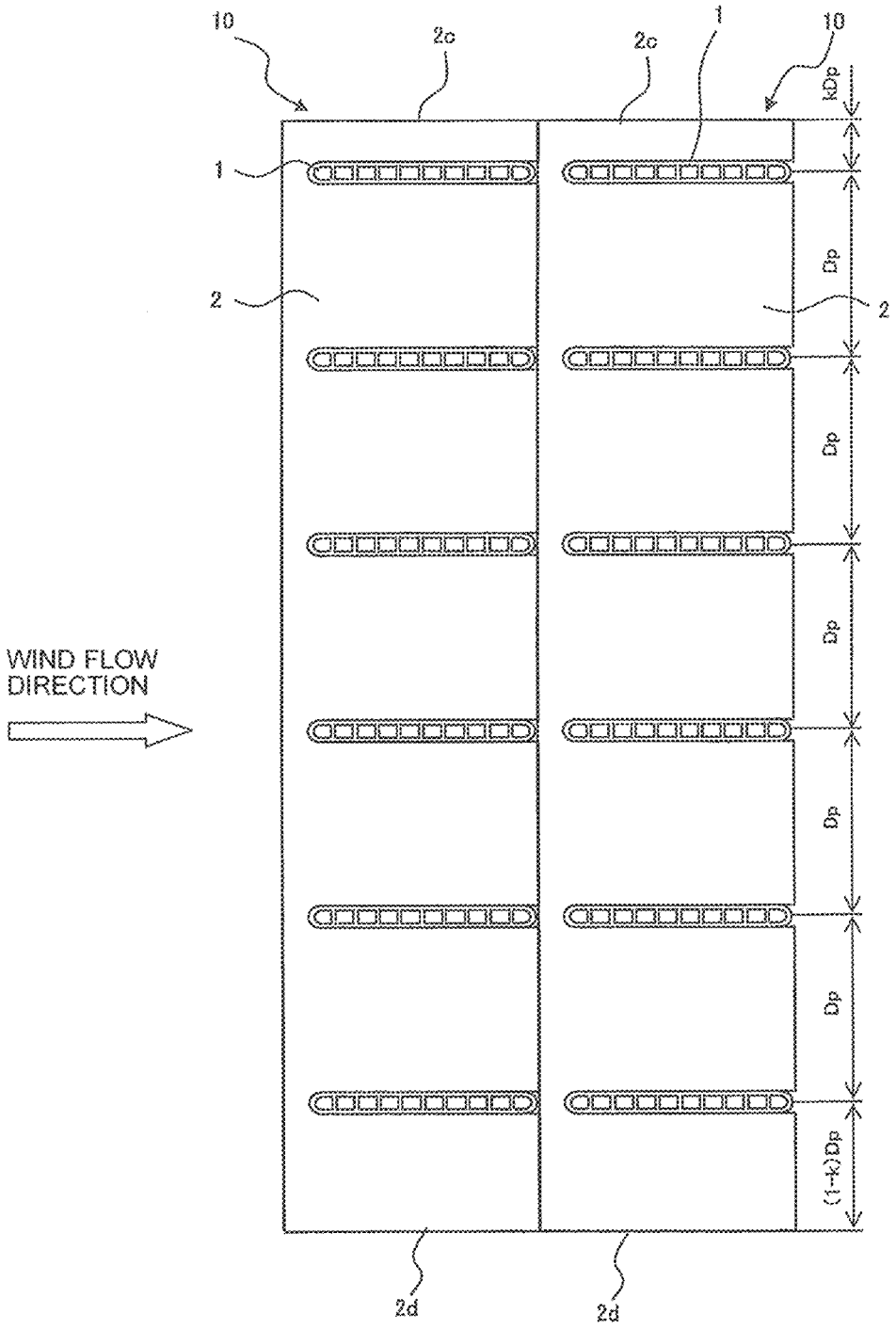
FIG. 4 is a front view of flat tube heat exchangers (as a comparative example) in which two flat tube heat exchanger rows oriented in the same direction are coupled to each other.

FIG. 4 is a front view illustrating a configuration (a comparative example) in which a plurality of rows of the flat tube heat exchangers 10 described above oriented in the same direction are connected to each other. In a case where the two rows of flat tube heat exchangers 10 of the same shape are oriented in the same direction as illustrated in FIG. 4, the vertical ends of the fins 2 are aligned, but the flat tubes 1 form a grid pattern, resulting in a degradation of heat transmission performance compared with the staggered pattern.

Figure 5:
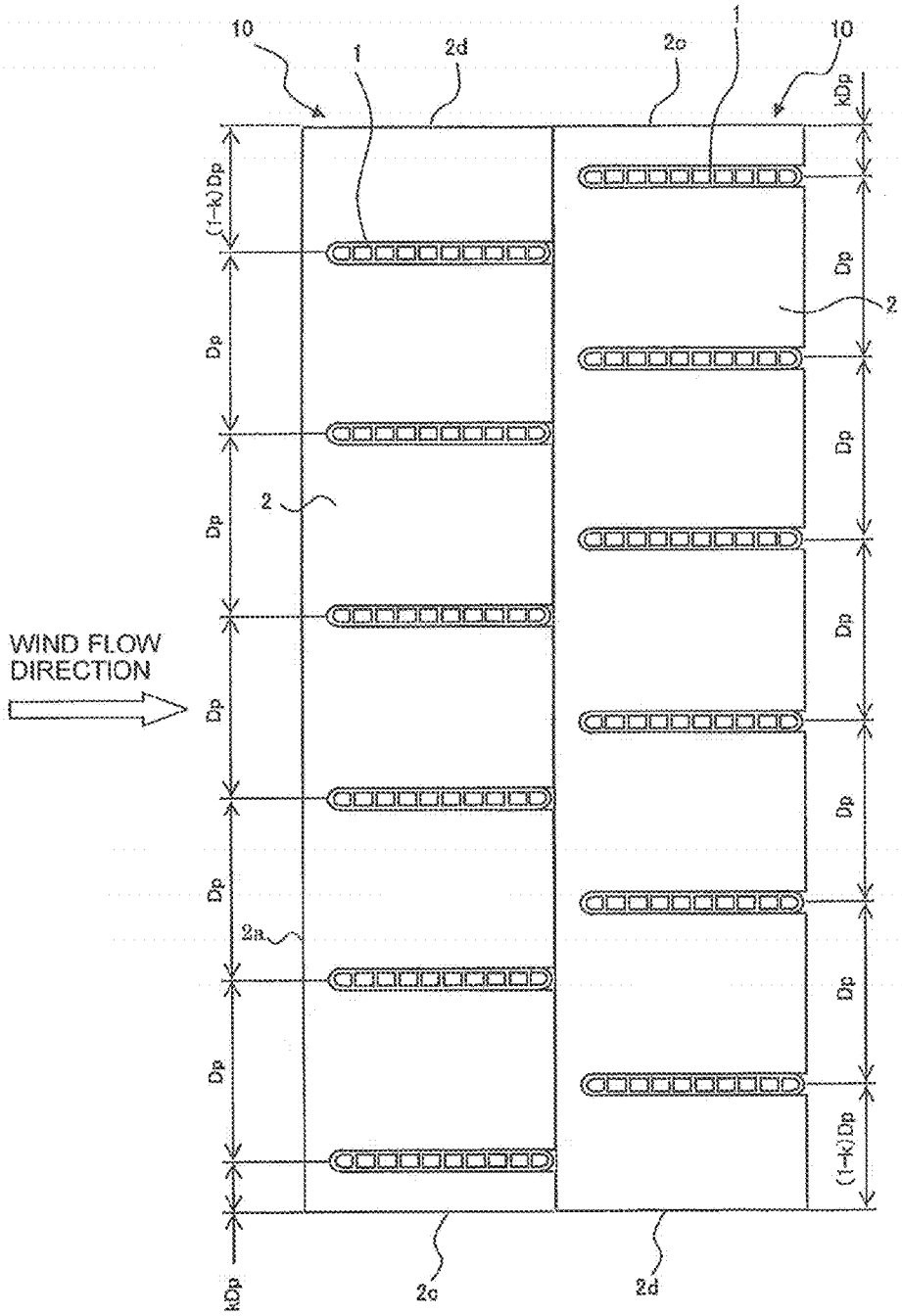
FIG. 5 is a front view of the flat tube heat exchangers of Embodiment of the present invention.

FIG. 5 is a front view illustrating flat tube heat exchangers having a two-row configuration according to Embodiment of the present invention. In these flat tube heat exchangers of Embodiment of the present invention, one of the two rows of the flat tube heat exchangers 10 to be coupled to each other is reversed in the vertical direction, thereby obtaining a staggered pattern exhibiting excellent heat transmission performance. For example, the shorter side 2*d* of the windward flat tube heat exchanger 10 corresponding to the fin lower ends is disposed at the top, whereas the shorter side 2*c* thereof corresponding to the fin upper ends is disposed at the bottom. That is, the first and second rows of the flat tube heat exchangers 10 having different distances between the shorter side 2*c* corresponding to the fin uppers end or the shorter side 2*d* corresponding to the fin lower ends and the flat tubes 1 are oriented in opposite directions with respect to the stage direction of the flat tubes 1.

Figure 6:
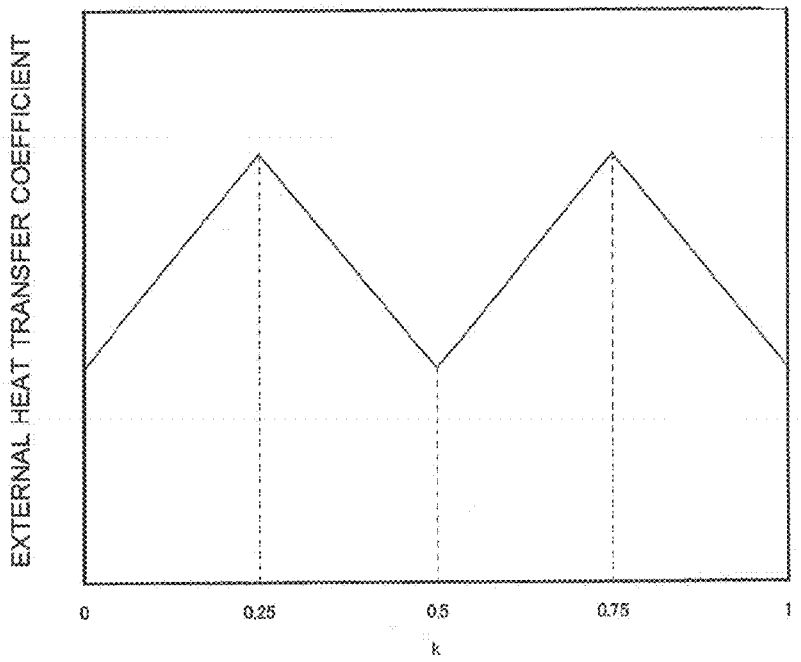
FIG. 6 is a graph showing a relationship between an external heat transfer coefficient and a coefficient k in the flat tube heat exchangers of Embodiment of the present invention.

FIG. 6 is a graph showing a relationship between an external heat transfer coefficient and a coefficient k in the flat tube heat exchanger 10 of Embodiment of the present invention. In FIG. 6, the abscissa represents k and the ordinate represents an external heat transfer coefficient.

As shown in FIG. 6, when k is 0, 0.5, or 1, the external heat transfer coefficient is at minimum. This is because the flat tubes 1 form a grid pattern.

When k is 0.25 or 0.75, the external heat transfer coefficient is at maximum. This is because the flat tubes 1 form a complete staggered pattern. The complete staggered pattern herein refers to a pattern in which each of the flat tubes 1 of one of the single-row flat tube heat exchangers 10 is positioned at the middle height between the vertically adjacent flat tubes 1 of the other single-row flat tube heat exchangers 10 in FIG. 5.

Figure 7:
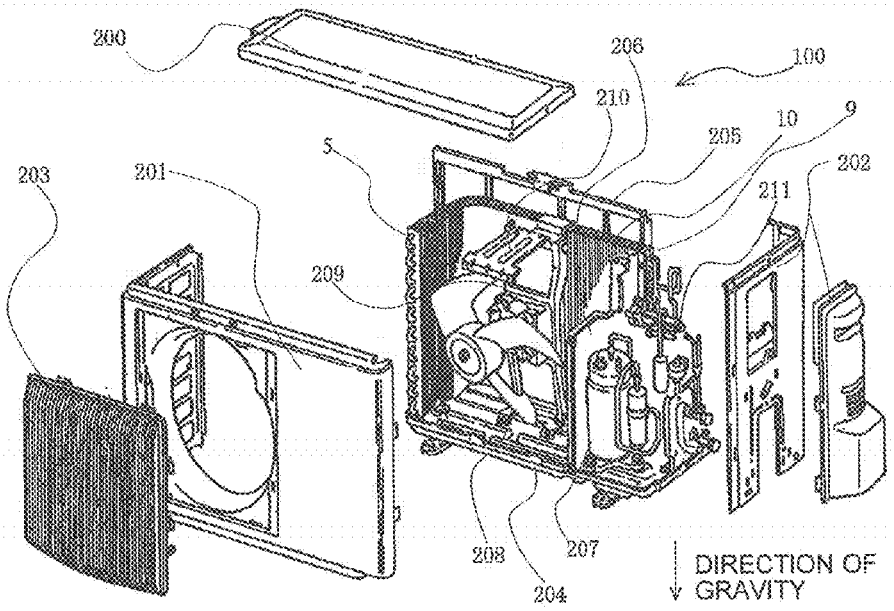
FIG. 7 illustrates an example of an outdoor unit in which the flat tube heat exchangers of Embodiment of the present invention are installed.

FIG. 7 illustrates a side-air-flow type outdoor unit that is used for a room air conditioner, for example. The outer case of the outdoor unit 100 includes: a top panel 200 constituting the top surface of the outdoor unit 100; a front panel 201 constituting part of the front surface and the left side surface of the outdoor unit 100; a side panel 202 constituting the right side surface and part of the back surface of the outdoor unit 100; a fan grille 203 disposed on the front panel 201, constituting part of the front surface of the outdoor unit 100, and being made of a lattice member composed of, for example, vertical bars and horizontal bars; a base panel 204 which constitutes the bottom surface of the outdoor unit 100 and on which the flat tube heat exchangers 10 and other components are mounted; and a back panel 205 constituting part of the back surface of the outdoor unit 100.

The outdoor unit 100 includes: a partition plate 206 dividing the inner space of the outdoor unit 100 into a left section and a right section; a compressor 207 compressing refrigerant and discharging the compressed refrigerant; a propeller fan 208 supplying outdoor air to the flat tube heat exchangers 10; an electric motor 209 rotating the propeller fan 208; a motor support 210 holding the electric motor 209; and a four-way valve 211 for switching a refrigerant channel.

Figure 8:
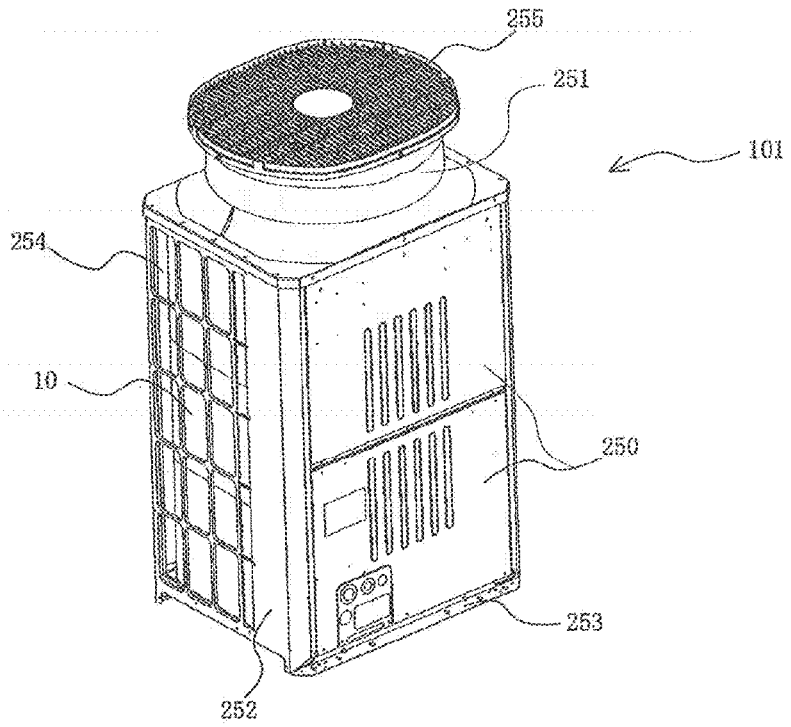
FIGS. 8(*a*) and 8(*b*) illustrate another example of the outdoor unit in which the flat tube heat exchangers of Embodiment of the present invention are installed, FIG. 8(*a*) is an outside view, and FIG. 8(*b*) illustrates an internal structure.
Figure 8:
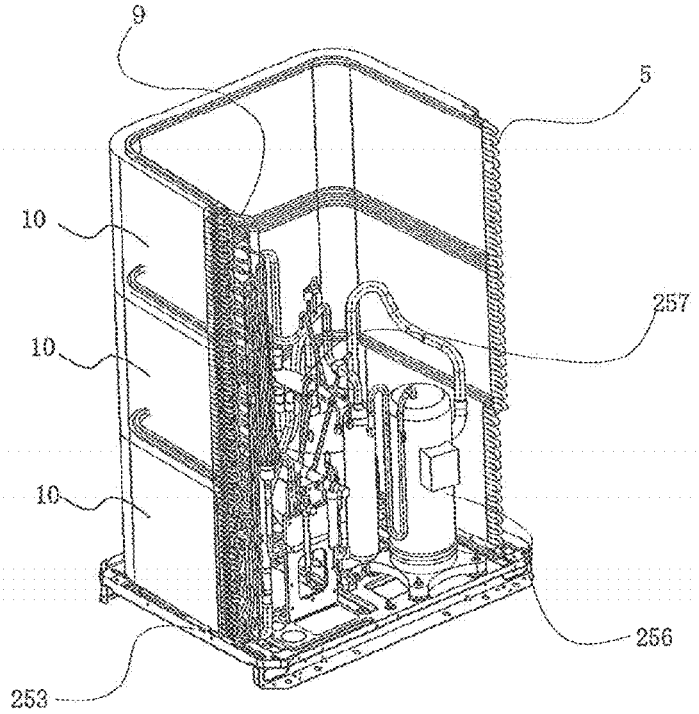

FIG. 8 illustrates a top-air-flow type outdoor unit that is used for, for example, an industrial air conditioner installed on a rooftop of a building. The outdoor unit 101 includes a front panel 250 constituting the outer case at the front surface of the outdoor unit 101, a fan guard 251 disposed at the top of the outdoor unit 101, a side panel 252 constituting the outer case of the side surface of the outdoor unit 101, and a base panel 253 supporting the flat tube heat exchangers 10 and other components. Air inlets 254 for taking in air are formed in the side surfaces and the back surface of the outer case of the outdoor unit 101, and an air outlet 255 for discharging air to the outside is provided at the top of the outdoor unit 101. That is, the outdoor unit 101 includes the air inlets 254 formed in the side panel 252 and used for taking in air into the outdoor unit 101 and the air outlet 255 formed in the fan guard 251 and used for discharging releasing air in the outdoor unit 101 to the outside of the outdoor unit 101.

The outdoor unit 101 includes a compressor 256 for compressing refrigerant and discharging the compressed refrigerant and a four-way valve 257 for switching a refrigerant channel. Switching of the channel with the four-way valve 257 enables the flat tube heat exchanger 10 to serve as a condenser (a radiator) in a cooling operation so that the refrigerant is subjected to condensation liquefaction, and to serve as an evaporator in a heating operation so that the refrigerant is subjected to evaporation vapourization. In FIG.

8, three stages of flat tube heat exchangers 10 are vertically stacked. However, the present invention is not limited to this example, and the flat tube heat exchangers 10 do not need to be stacked.

In each of the outdoor unit 100 and the outdoor unit 101 illustrated in FIGS. 7 and 8, the flat tube heat exchangers 10 are disposed perpendicularly to the base panel 204 and the base panel 253. In general, the flat tube heat exchangers 10 are disposed on the base panel 204 and the base panel 253 with the ends of single-row flat tube heat exchangers 10 being aligned.

This is because a variation in height increases the height of the flat tube heat exchangers 10 accordingly, and unnecessarily increases the height of the outdoor unit 100 or the outdoor unit 101, resulting in an increase in size. The increased height of the outdoor unit 100 or the outdoor unit 101 makes it difficult to transport and convey the outdoor unit 100 or the outdoor unit 101, respectively. In addition, in the case of additional vibration of the flat tube heat exchangers 10 due to an earthquake, for example, a local load applied to the bottoms of the flat tube heat exchangers 10 increases. To reduce such disadvantages, the ends of the flat tube heat exchangers 10 are aligned.

Figure 9:
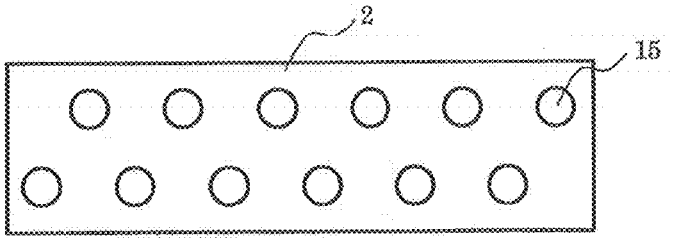
FIG. 9 is an illustration for describing a method for fabricating circular tube heat exchangers.

FIG. 9 is an illustration for describing a method for fabricating a circular tube heat exchanger. Referring to FIG. 9, the method for fabricating a circular tube heat exchanger will be described. In the case of a circular tube, a plurality of parallel fins 2 are fixed, and circular tubes are inserted into attachment sides of U-bends 6 from front to back as in the drawing. The circular tube insertion holes 15 of the fins 2 are larger than the outer diameter of the circular tubes. Since the circular tube insertion holes 15 of the fins 2 are larger than the outer diameter of the circular tubes, variations in positional accuracy of the circular tubes of the fins 2 are permitted, and thus, the circular tubes can be easily inserted into the fins 2. Then, tube-expanding balls are inserted into the circular tubes in the direction orthogonal to the surfaces of the fins, thereby increasing the outer diameter of the circular tubes. In this manner, the circular tubes come into close contact with fin collars provided on the fins 2, thereby reducing contact thermal resistance between the circular tubes and the fins. In the case of the circular tubes, in the case of disposing a plurality of rows, the circular tubes and the tube-expanding balls can be inserted at the same time.

On the other hand, in the case of the flat tubes 1, it is difficult to increase the outer diameter of the flat tubes 1 after inserting the tube-expanding balls into the flat tubes 1 in the direction orthogonal to the surfaces of the fins 2. This is because a plurality (nine in the example illustrated in FIG. 1) of partitions 13 are provided in the flat tubes 1 in order to increase pressure capacity. Accordingly, in the case of the flat tubes 1, the flat tubes 1 and the fins 2 are generally brazed in order to reduce contact thermal resistance between the flat tubes 1 and the fins 2.

In the case of circular tubes, since the circular tube insertion holes 15 of the fins 2 are larger than the outer diameter of the circular tubes during insertion of the circular tubes into the fins 2, the circular tubes can be easily inserted into the fins 2. In the case of the flat tubes 1, however, as the size of the slits 4 of the fins 2 increases relative to the outer diameter of the flat tubes 1, it becomes more difficult for brazing to fill a gap between fin collars on the fins 2 and the flat tubes 1, resulting in a tendency for increased contact thermal resistance. In such circumstances, the outer diameter of the slits 4 formed in the fins 2 is limited, and it is more difficult to insert the flat tubes 1 into the slits 4 of the fins 2 than in the case of circular tubes.

Next, four methods for fabricating flat tube heat exchangers 10 which have a staggered pattern with aligned upper and lower ends of the fins 2 and in which the orientations of the hairpin corners 5 are not opposite to those of the U-bends 6 will be described. As described above, in the example illustrated in FIG. 5, only the first row in FIG. 4 is vertically reversed. In a configuration in which only one of the first row or the second row is vertically reversed, the orientations of the hairpin corner 5 and the U-bends 6 in FIG. 2 are also reversed. Specifically, suppose two single-row flat tube heat exchangers 10 are provided and one of the two single-row flat tube heat exchangers 10 is vertically reversed, a staggered pattern can be formed. However, the hairpin corners 5 of one of the single-row flat tube heat exchangers 10 are located at the side opposite to the hairpin corners 5 of the other single-row flat tube heat exchanger 10.

A first method will be described with reference to FIGS. 10(*a*) and 10(*b*). In this method, the flat tubes 1 are fixed, and the fins 2 are inserted into the flat tubes 1.

Figure 10:
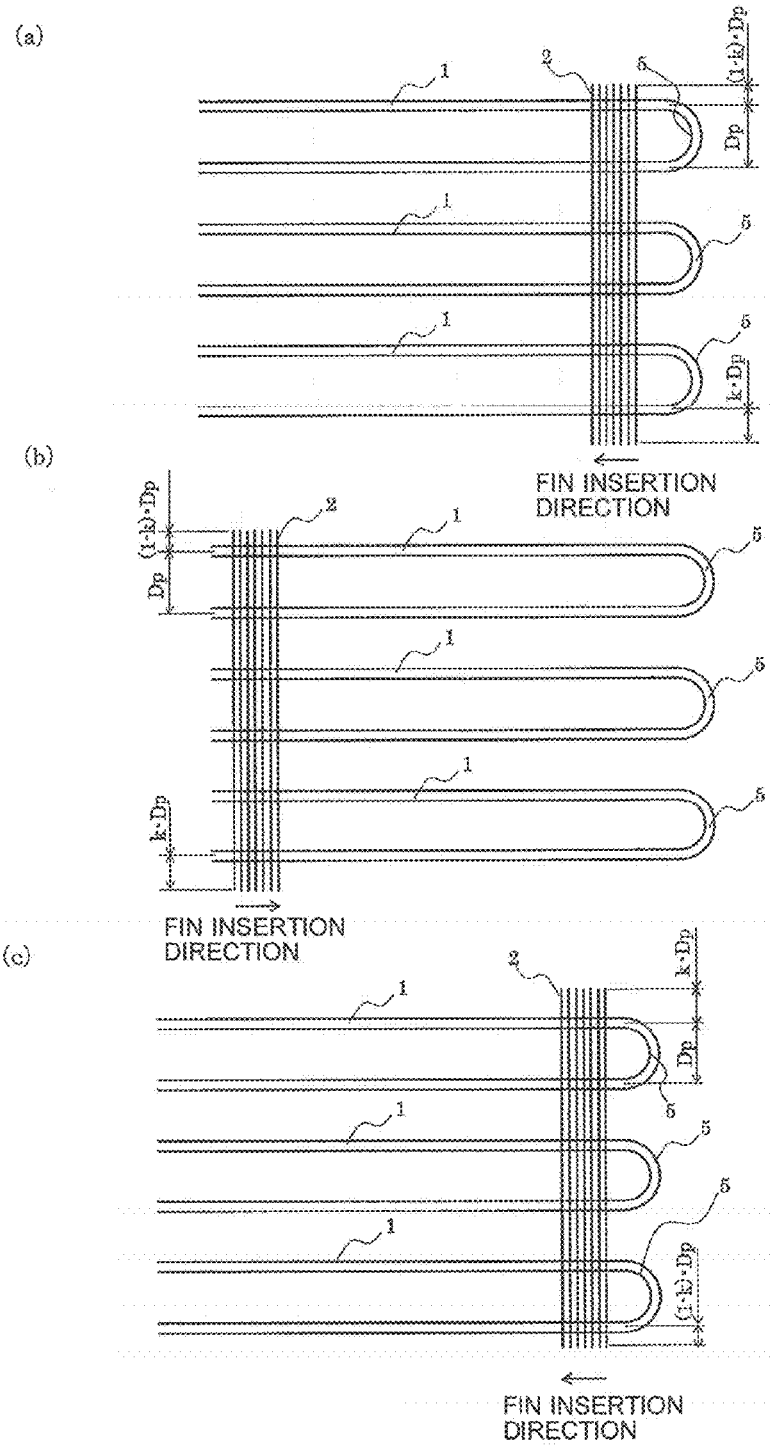
FIG. 10 shows illustrations for describing first and second methods for fabricating flat tube heat exchangers of Embodiment of the present invention.

As illustrated in FIG. 10(*a*), the fins 2 are sequentially inserted into the flat tubes 1 from the hairpin corner 5 such that the distance between the upper ends of the fins 2 and the flat tubes 1 is $(1-k)\cdot Dp$ and the distance between the lower ends of the fins 2 and the flat tubes 1 is $k\cdot Dp$. The configuration illustrated in FIG. 10(*a*) is used for the odd-numbered rows of the single-row flat tube heat exchangers 10. On the other hand, as illustrated in FIG. 10(*b*), the fins 2 are inserted into the flat tubes 1 from the side to which the U-bends 6 are attached such that the distance between the upper ends of the fins 2 and the flat tubes 1 is $k\cdot Dp$ and the distance between the lower ends of the fins 2 and the flat tubes 1 is $(1-k)\cdot Dp$. The positional relationship of the slits 4 of the fins 2 is reversed with respect to the flat tubes 1 between FIG. 10(*a*) and FIG. 10(*b*).

Then, as illustrated in FIG. 10(*b*), after the fins 2 have been inserted into the flat tubes 1, the single-row flat tube heat exchangers 10 are rotated to be vertically reversed with the left and right of the single-row flat tube heat exchangers 10 in FIG. 10(*b*) being maintained. The rotated single-row flat tube heat exchangers 10 are overlaid on the flat tube heat exchangers 10 as illustrated in FIG. 10(*a*), thereby forming a plurality of rows of flat tube heat exchanger 10 in which (1) the upper and lower ends are aligned, (2) the hairpin corner 5 and the U-bends 6 are aligned, and (3) the flat tubes 1 form a staggered pattern.

A second method will be described with reference to FIGS. 10(*a*) and 10(*c*). The second method uses the single-row flat tube heat exchangers 10 illustrated in FIG. 10(*a*) and the single-row flat tube heat exchangers 10 illustrated in FIG. 10(*c*). In FIG. 10(*c*), the fins 2 are sequentially inserted into the flat tubes 1 from the side of the hairpin corner 5 such that the distance between the upper end of the fins 2 and the flat tubes 1 is $k\cdot Dp$ and the distance between the lower ends of the fins 2 and the flat tubes 1 is $(1-k)\cdot Dp$. Thus, the positional relationship of the fins 2 is reversed with respect to the vertical direction between FIG. 10(*a*) and FIG. 10(*c*). The single-row flat tube heat exchangers 10 illustrated in FIG. 10(*c*) are overlaid on the flat tube heat exchanger 10 illustrated in FIG. 10(*a*) with the left and right and the top and bottom of the flat tube heat exchangers 10 being maintained, thereby forming a plurality of rows of flat tube heat exchangers 10 in which (1) upper and lower ends are aligned, (2) the hairpin corner 5 and the U-bends 6 are aligned, and (3) the flat tubes 1 form a staggered pattern.

With the first and second methods described above, flat tube heat exchangers 10 illustrated in FIG. 5 and flat tube heat exchangers 10 illustrated in FIG. 16, which will be described later, can be fabricated.

Figure 11:
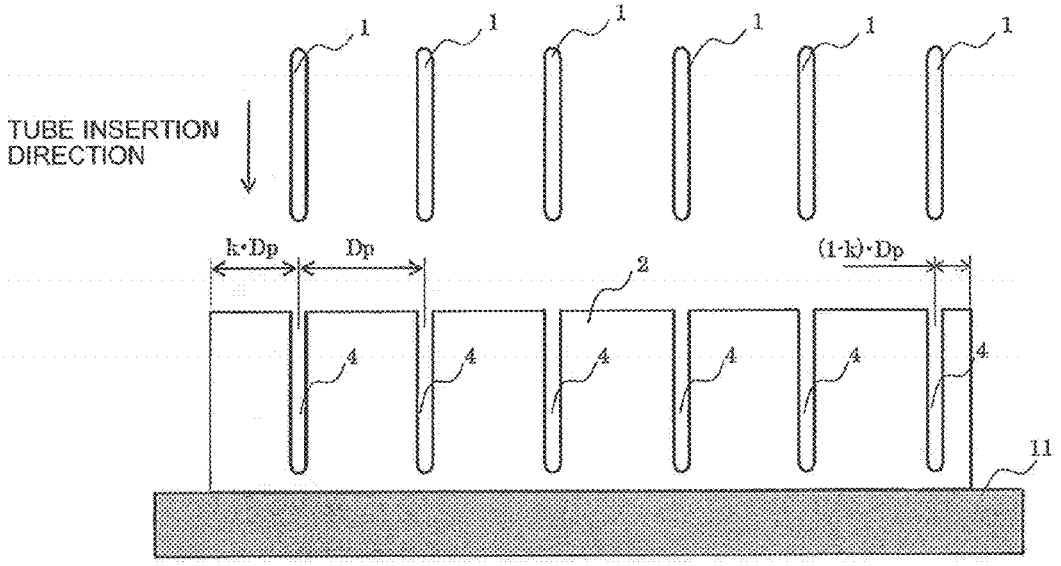
FIG. 11 shows a third method for fabricating flat tube heat exchangers of Embodiment of the present invention, which is different from the method shown in FIG. 10.
Figure 11:
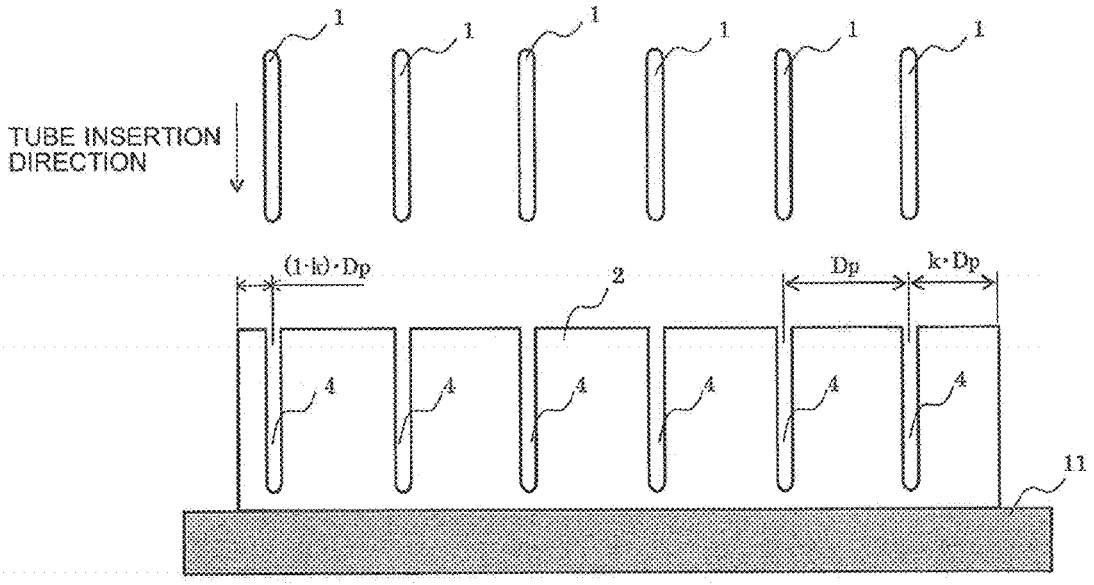

FIG. 11 shows a third method for fabricating flat tube heat exchangers 10 according to Embodiment, which is different from the method shown in FIG. 10. The third method will be described with reference to FIG. 11. In FIG. 10, for the first and second methods, the flat tubes 1 are fixed and the fins 2 are inserted into the flat tubes 1. Alternatively, in the method shown in FIG. 11, the fins 2 are fixed and the flat tubes 1 are inserted into the slits 4 of the fins 2.

In FIG. 11(*a*), the left ends of the fins 2 are located at k·Dp, the right ends of the fins 2 are located at (1−k)·Dp, and the flat tubes 1 are inserted into the fins 2 from above. These flat tube heat exchangers 10 are used for an odd-numbered row. For an even-numbered row, only the orientations of the hairpin corner 5 are made opposite to those of the U-bends 6 during insertion of the flat tubes 1, or as illustrated in FIG. 11(*b*), the left ends of the fins 2 are located at (1−k)·Dp, the right ends thereof are located at k·Dp, and the flat tubes 1 are inserted from above. The thus-fabricated flat tube heat exchangers 10 for the odd-numbered row and the thus-fabricated flat tube heat exchangers 10 for the even-numbered row are combined, thereby forming a plurality of rows of the flat tube heat exchangers 10 in which (1) the upper and lower ends are aligned, (2) the hairpin corner 5 and the U-bends 6 are aligned, and (3) the flat tubes 1 form a staggered pattern.

In a configuration in which the flat tube heat exchangers 10 for the odd-numbered rows are replaced by the flat tube heat exchangers 10 for the even-numbered rows and the flat tube heat exchangers 10 for the even-numbered rows are replaced by the flat tube heat exchangers 10 for the odd-numbered rows, it is also possible to fabricate a plurality of flat tube heat exchangers 10 in which (1) the upper and lower ends are aligned, (2) the hairpin corner 5 and the U-bends 6 are aligned, and (3) the flat tubes 1 form a staggered pattern.

However, in the method shown in FIG. 11, the flat tube heat exchangers 10 need to be fabricated for each row, and a plurality of rows of flat tube heat exchangers 10 cannot be fabricated at the same time.

Figure 12:
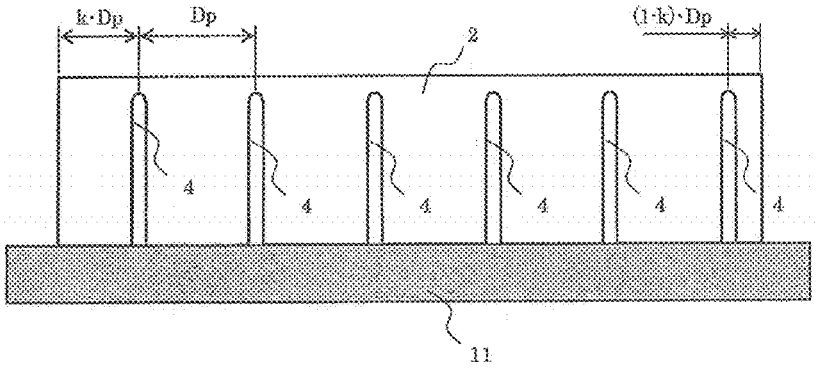
FIG. 12 shows a fourth method for fabricating flat tube heat exchangers of Embodiment of the present invention, which is different from the methods shown in FIGS. 10 and 11.
Figure 12:
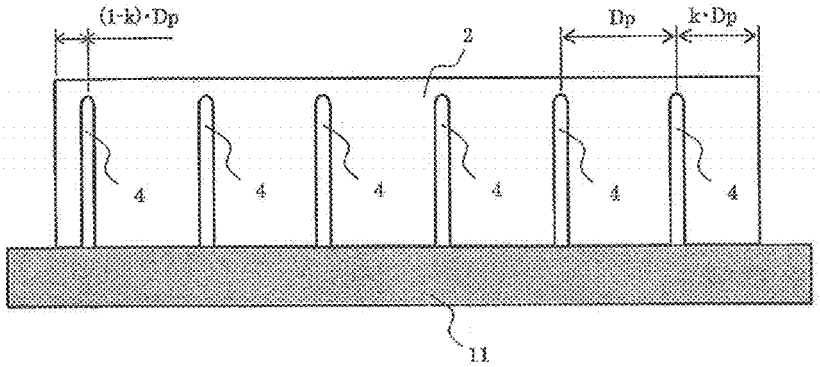

FIG. 12 shows a fourth method for fabricating flat tube heat exchangers 10 according to Embodiment, which is different from the methods shown in FIGS. 10 and 11. The fourth method will be described with reference to FIG. 12. In the method shown in FIG. 12, in a manner similar to that shown in FIG. 11, the fins 2 are fixed and the flat tubes 1 are inserted into the fins 2.

In FIG. 12(*a*), the flat tubes 1 are inserted into the slits 4 of the fins 2 from a side to which the U-bends 6 are attached from front to back in the drawing sheet with the left ends of the fins 2 being located at k·Dp and the right ends of the fins 2 being located at (1−k)·Dp. This configuration is used for odd-numbered rows. For even-numbered rows, the insertion direction of the flat tubes 1 is reversed, that is, from back to front of the drawing sheet in the insertion of the odd-numbered rows of the flat tubes 1, or as illustrated in FIG. 12(*b*), the flat tubes 1 are inserted from front to back with the left ends of the fins 2 being located at (1−k)·Dp and the right ends of the fins 2 being located at k·Dp. The thus-fabricated flat tube heat exchangers 10 for the odd-numbered rows and the thus-fabricated flat tube heat exchangers 10 for the even-numbered rows are combined, thereby fabricating a plurality of flat tube heat exchangers 10 in which (1) the upper and lower ends are aligned, (2) the hairpin corner 5 and the U-bends 6 are aligned, and (3) the flat tubes 1 form a staggered pattern.

In a configuration in which the flat tube heat exchangers 10 for the odd-numbered rows are replaced by the flat tube heat exchangers 10 for the even-numbered rows and the flat tube heat exchangers 10 for the even-numbered rows is replaced by the flat tube heat exchangers 10 for the odd-numbered rows, it is also possible to fabricate a plurality of flat tube heat exchangers 10 in which (1) the upper and lower ends are aligned, (2) the hairpin corner 5 and the U-bends 6 are aligned, and (3) the flat tubes 1 form a staggered pattern.

In the method shown in FIG. 12, a plurality of rows of single-row flat tube heat exchangers 10 can be fabricated at the same time. However, the accuracy in positioning the fins 2 and the accuracy in insertion locations of the flat tubes 1 are needed. Thus, to obtain the accuracies, a complicated fixing jig is needed and/or the speed of inserting the flat tubes 1 in the fins 2 needs to be reduced. In such cases, the methods described in FIGS. 10 and 11 can be employed.

Figure 13:
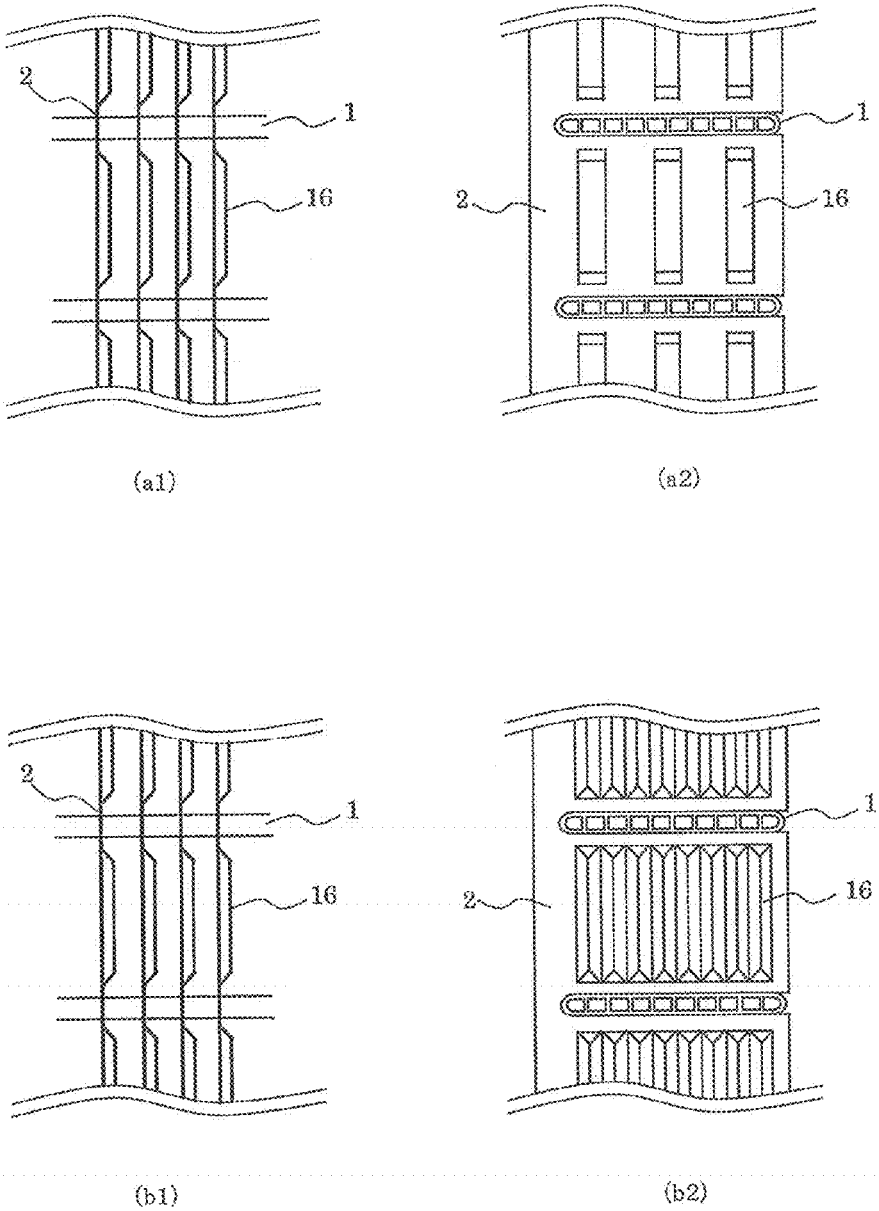
FIG. 13 illustrates heat exchange accelerators formed on the fins of the flat tube heat exchangers of Embodiment of the present invention.
Figure 14:
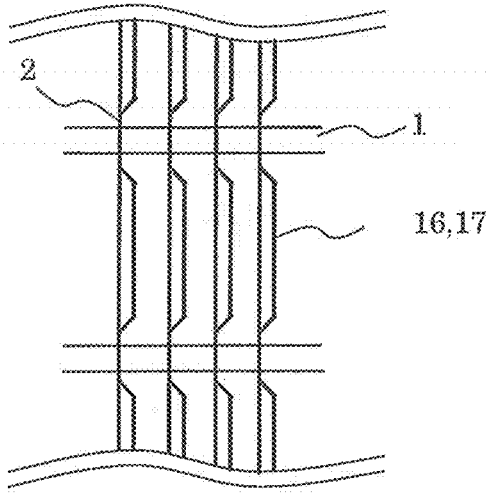
FIG. 14 illustrates heat exchange accelerators on odd-numbered rows of the flat tube heat exchangers and heat exchange accelerators on even-numbered rows of the flat tube heat exchangers of Embodiment of the present invention.
Figure 14:
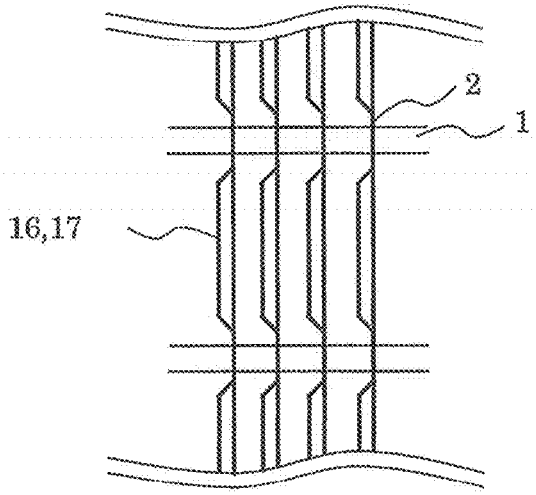

FIG. 13 illustrates heat exchange accelerators formed on the fins 2 of the flat tube heat exchanger 10 of Embodiment. FIG. 14 illustrates heat exchange accelerators on odd-numbered rows of the flat tube heat exchangers 10 and heat exchange accelerators on even-numbered rows of the flat tube heat exchangers 10 of Embodiment.

The fins 2 may include heat exchange accelerators serving as heat receivers or heat radiators, as well as the slits 4. Examples of the heat exchange accelerators include lanced parts 16 (see the side view of FIG. 13 (*a*1) and the front view of FIG. 13 (*a*2)) formed by lancing the surfaces of the fins 2 and waffle-like portions 17 (see the side view of FIG. 13 (*b*1) and the front view of FIG. 13 (*b*2)) formed by forming unevenness on the surfaces of the fins 2.

In the flat tube heat exchangers 10 as a combination of the flat tube heat exchangers 10 illustrated in FIG. 10(*a*) and the flat tube heat exchangers 10 illustrated in FIG. 10(*b*), the fins 2 illustrated in FIG. 10(*a*) and the fins 2 illustrated in FIG. 10(*b*) can be formed by using a mold of the same shape. In this manner, as illustrated in FIG. 14, the locations of the lanced parts 16 and the waffle-like portions 17 are reversed with respect to the vertical direction in the drawing between the odd-numbered rows and the even-numbered rows, and the external heat transfer coefficient of the flat tube heat exchangers 10 can be increased by several percent. This is because of the following reasons. In a case where the locations of the lanced parts 16 and the waffle-like portions 17 are the same in the horizontal direction in the first and second rows, heat exchange is locally performed in a portion where the lanced parts 16 and the waffle-like portions 17 are disposed. On the other hand, in a case where the locations of the lanced parts 16 and the waffle-like portions 17 are reversed with respect to the vertical direction in the drawing between the first and second rows, the heat exchange is evenly performed. That is, the method employing a combination of the methods of FIGS. 10(*a*) and 10(*b*) can be expected to increase the external heat transfer coefficient while reducing the cost for fabricating a plurality of types of molds for forming the fins 2. The flat tube heat exchangers 10 fabricated by combining the methods of FIGS. 11(*a*) and 11(*b*) as described above can obtain similar advantages.

In fabricating the flat tube heat exchangers 10 by combining the methods of FIGS. 10(*a*) and 10(*c*), different molds are used for forming the fins 2.

Figure 15:
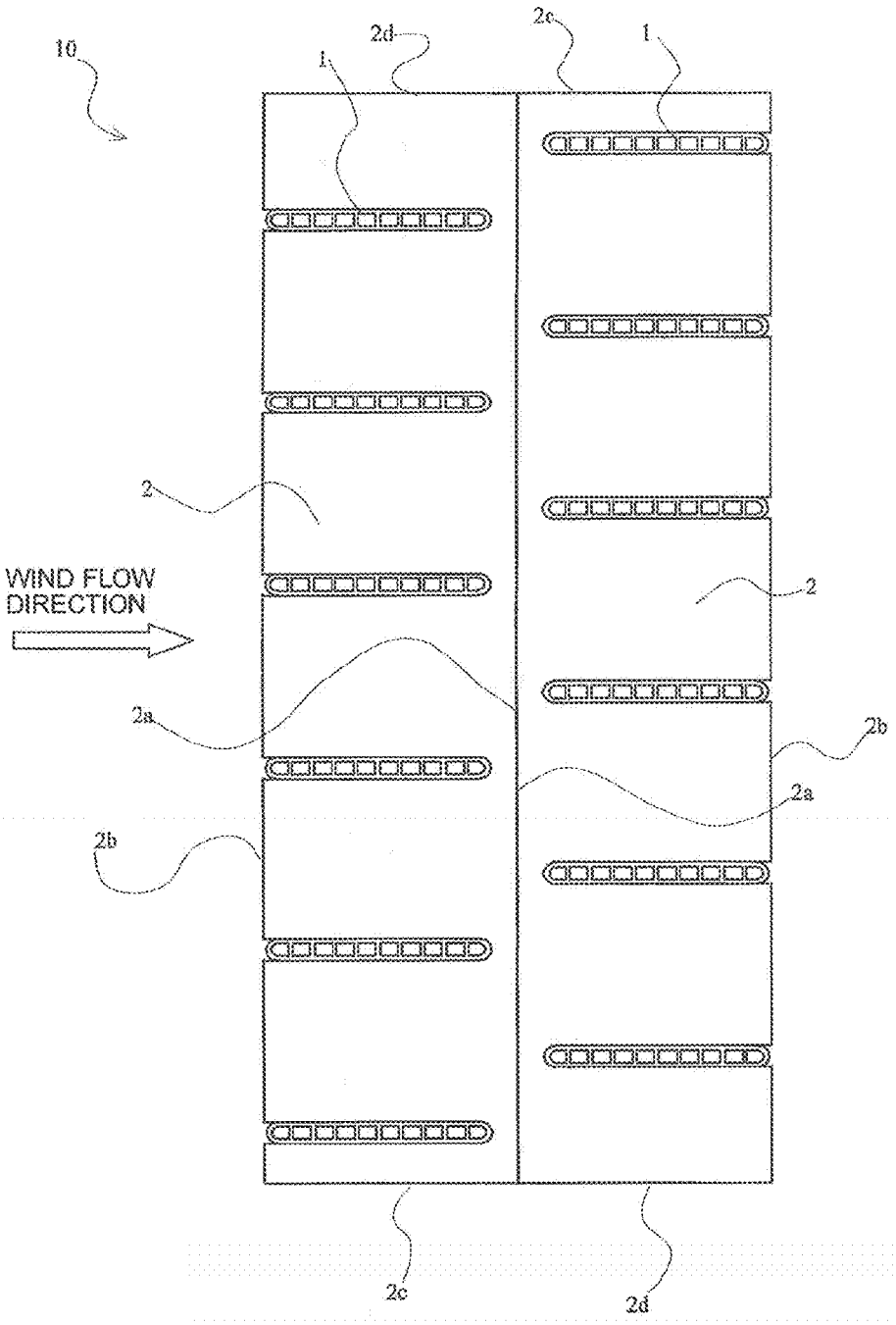
FIG. 15 illustrates a first variation of the flat tube heat exchangers illustrated in FIG. 5.

FIG. 15 illustrates a first variation of the flat tube heat exchangers illustrated in FIG. 5. In the example of FIG. 5, two of the single-row flat tube heat exchangers (flat tube heat exchanger rows) 10 are coupled together such that a side at which the slits 4 of the fins 2 are open faces a side at which the slits 4 of the fins 2 are not open. Alternatively, in the example of FIG. 15, two of the single-row flat tube heat exchangers (flat tube heat exchanger rows) 10 are coupled together such that sides at which the slits 4 of the fins 2 are not open face each other. Specifically, a plurality of slits 4 in which the flat tubes 1 are to be inserted are formed at one side of the fins 2, and the odd-numbered single-row flat tube heat exchangers 10 are coupled to even-numbered single-row flat tube heat exchangers 10 such that the other side of the fins 2 in the odd-numbered single-row flat tube heat exchangers 10 faces the other side of the fins 2 in the even-numbered single-row flat tube heat exchangers 10. The configuration illustrated in FIG. 15 can also obtain similar advantages as those obtained in the configuration illustrated in FIG. 5. That is, the flat tubes 1 can form a staggered pattern, thereby enhancing heat transmission performance. The flat tube heat exchangers 10 as illustrated in FIG. 15 can be fabricated by, for example, preparing two single-row flat tube heat exchangers 10 illustrated in FIG. 10(*a*) and the top and bottom of one of the two single-row flat tube heat exchangers 10 are reversed with the left and right thereof being maintained.

In flat tube heat exchangers including 2n rows (where n is an integer) of the single-row flat tube heat exchangers (flat tube heat exchanger rows) 10, the flat tubes 1 are enabled to form a staggered pattern by disposing the third or its subsequent rows of the flat tube heat exchangers 10 are arranged in units of two rows as illustrated in FIG. 5 or FIG. 15. In the case of (2n+1) rows, (2n+2) rows of the flat tube heat exchangers 10 may be arranged in units of two rows, and the (2n+2)st row is omitted.

As described above, in Embodiment, in the single-row flat tube heat exchangers (flat tube heat exchanger rows) 10 of the same shape as illustrated in FIG. 5, a staggered pattern can be formed by disposing the flat tubes 1 in the first row at the side opposite to the flat tubes 1 in the second row such that the relationship of $0<k<0.5$ or $0.5<k<1$ (where Dp is the stage pitch of the flat tubes 1 and k is a coefficient of Dp) is established, the distance between the shorter side 2*c* corresponding to the fin upper ends and the flat tubes 1 is $k \cdot Dp$ and the distance between the shorter side 2*d* corresponding to the fin lower ends and the flat tubes 1 is $(1-k) \cdot Dp$. As a result, the external heat transfer coefficient can be increased. In addition, the fin ends can be aligned. Thus, the size of equipment including the flat tube heat exchangers can be reduced without an increase in installation space of the flat tube heat exchangers.

Further, since the flat tube heat exchangers 10 to be combined have the same shape, one type of a mold is sufficient for the fins 2, thereby contributing to reduction in fabrication cost.

The coefficient k of 0.25 or 0.75 can particularly increase the external heat transfer coefficient.

Figure 16:
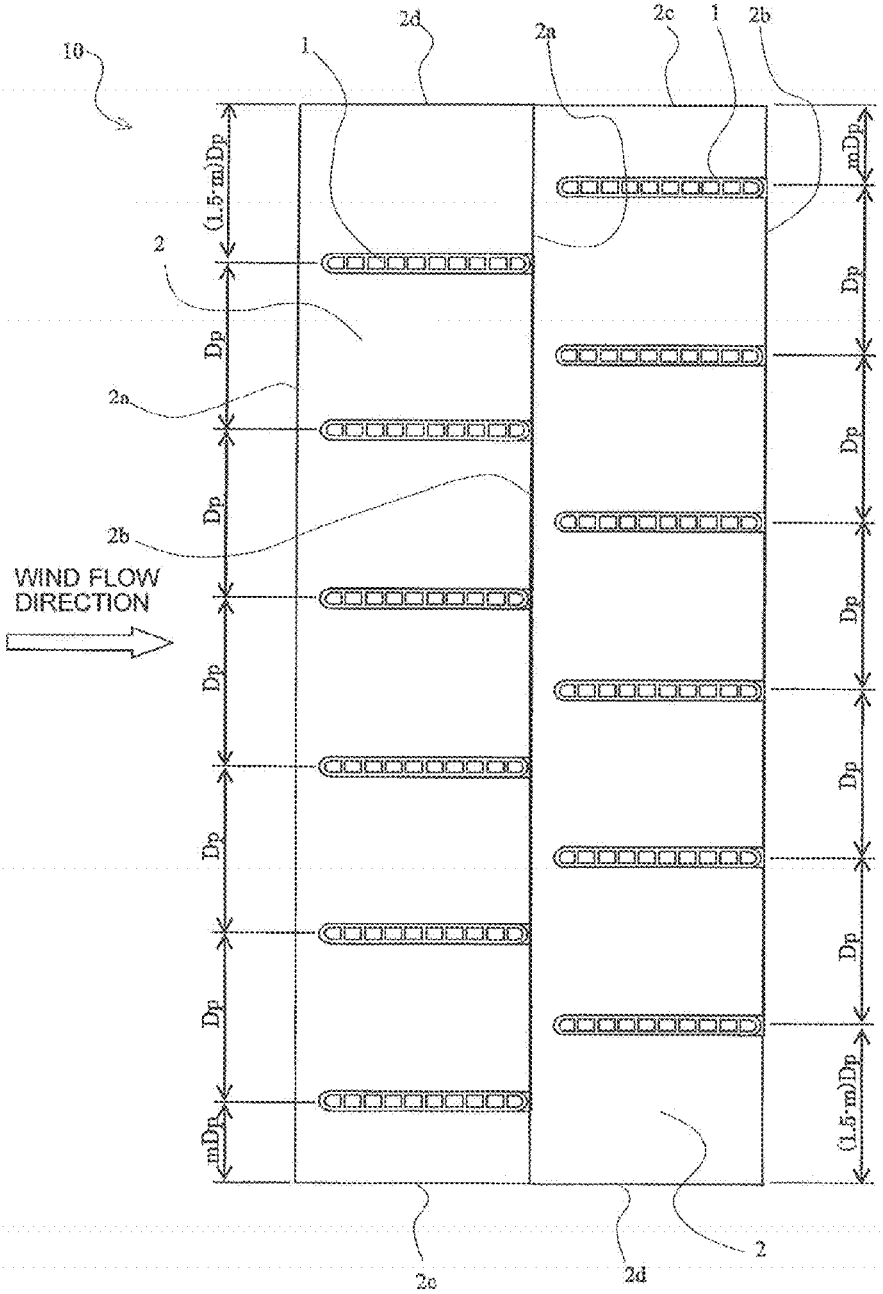
FIG. 16 illustrates a second variation of the flat tube heat exchangers illustrated in FIG. 5.
Figure 17:
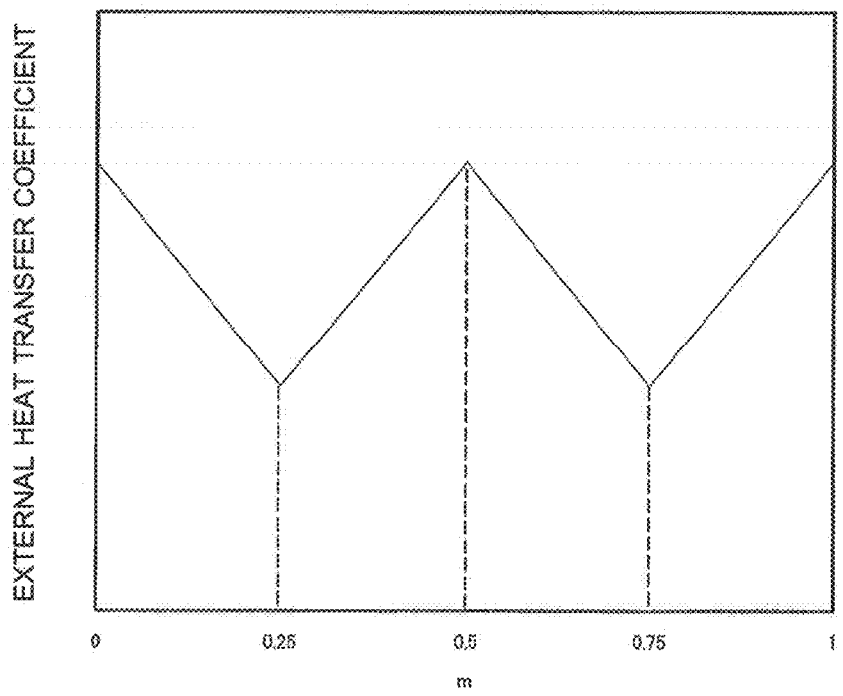
FIG. 17 shows a relationship between an external heat transfer coefficient and a coefficient k in the flat tube heat exchangers illustrated in FIG. 16.

FIG. 16 illustrates a second variation of the flat tube heat exchangers 10 illustrated in FIG. 5. FIG. 17 shows a relationship between an external heat transfer coefficient and a coefficient k in the flat tube heat exchangers 10 illustrated in FIG. 16. As illustrated in FIG. 16, a staggered pattern may be formed by setting $0 \leq m \leq 1$ and locating the fin ends at $m \cdot Dp$ and $(1.5-m) \cdot Dp$. At this time, as shown in FIG. 17, the external heat transfer coefficient of the flat tube heat exchangers is at maximum when m is 0, 0.5, or 1. This is because the flat tubes 1 form a complete staggered pattern.

In the examples illustrated in FIGS. 5, 15, and 16, two single-row flat tube heat exchangers 10 are provided. However, the present invention is not limited to these examples, and two or more single-row flat tube heat exchangers 10 may be provided.

REFERENCE SIGNS LIST

1 flat tube, 2 fin, 2*a* longer side, 2*b* longer side, 2*c* shorter sides (fin upper end), 2*d* shorter sides (fin lower end), 3 channel, 4 slit, 5 hairpin corner, 6 U-bend, 7 refrigerant inlet, 8 refrigerant outlet, 10 flat tube heat exchanger, 13 partition, 15 circular tube insertion hole, 16 lanced part, 17 waffle-like portion, 100 outdoor unit, 101 outdoor unit, 200 top panel, 201 front panel, 202 side panel, 203 fan grille, 204 base panel, 205 back panel, 206 partition plate, 207 compressor, 208 propeller fan, 209 electric motor, 210 motor support, 211 four-way valve, 250 front panel, 251 fan guard, 252 side panel, 253 base panel, 254 air inlet, 255 air outlet, 256 compressor, 257 four-way valve.

The invention claimed is:

1. An outdoor unit of an air-conditioning apparatus, the outdoor unit comprising flat tube heat exchangers including a plurality of single-row flat tube heat exchangers that are coupled to each other, each of the single-row flat tube heat exchangers including flat tubes each having a rounded rectangular shape with a high aspect ratio in cross section, the flat tubes allowing a heat exchange medium to flow therein, and a plurality of plate-shaped fins each provided, at one end thereof, with a plurality of insertion portions in which the flat tubes in a state of being bent into U shapes having hairpin corners are inserted, the fins being jointed to the flat tubes by brazing in a state where the flat tubes are inserted in the insertion portions, wherein in the flat tube heat exchangers, the flat tubes are arranged at a predetermined pitch in a stage direction orthogonal to a row direction of the fins, a distance between fin ends at one side in the stage direction of the fins and a center in a thickness direction of the flat tubes is $k \cdot Dp$ and a distance between fin ends at the other end in the stage direction of the fins and the center in the thickness direction of the flat tubes is $(1-k) \cdot Dp$, where Dp is a pitch of the flat tubes in the stage direction and k is a coefficient of Dp, and either $0<k<0.5$ or $0.5<k<1$, an odd-numbered one of the single-row flat tube heat exchangers is disposed in opposite orientation with respect to the stage direction to an even-numbered one of the single-row flat tube heat exchangers with regard to an air flow direction, upper and lower ends of the odd-numbered one of the single-row flat tube heat exchangers are aligned with upper and lower ends of the even-numbered one of the single-row flat tube heat exchangers, the fins are arranged orthogonally to the flat tubes, and the one end of each of the fins that is provided with the insertion portions, and one end of each of the flat tubes that is positioned at a shallow side with respect to each of the insertion portions, are aligned with each other.

2. The outdoor unit of claim 1, wherein k satisfies one of 0.25 and 0.75.

3. The outdoor unit of claim 1, wherein the fins of the flat tube heat exchangers have surfaces on which a plurality of heat exchange accelerators are disposed, and the odd-numbered one of the single-row flat tube heat exchangers and the even-numbered one of the single-row flat tube heat exchangers are disposed such that the heat exchange accelerators are disposed at a side of the odd-numbered one of the single-row flat tube heat exchangers opposite to a side of the even-numbered one of the single-row flat tube heat exchangers at which the heat exchange accelerators are disposed.

4. The outdoor unit of claim 3, wherein the heat exchange accelerators of the flat tube heat exchangers are lanced parts of surfaces of the fins or waffle-like portions that form uneven areas on the surfaces of the fins.

5. The outdoor unit of claim 1, wherein the flat tubes are inserted into the insertion portions that are cut out from a side of the fins, and two of the single-row flat tube heat exchangers are coupled to each other such that sides of the two of the single-row flat tube heat exchangers at which the insertion portions of the fins are not open face each other.

6. Flat tube heat exchangers as a plurality of single-row flat tube heat exchangers that are coupled to each other, each of the single-row flat tube heat exchangers comprising:

flat tubes each having a rounded rectangular shape with a high aspect ratio in cross section, the flat tubes allowing a heat exchange medium to flow therein; and a plurality of plate-shaped fins each provided, at one end thereof, with a plurality of insertion portions in which the flat tubes in a state of being bent into U shapes having hairpin corners are inserted, the fins being jointed to the flat tubes by brazing in a state where the flat tubes are inserted in the insertion portions, wherein the flat tubes are arranged at a predetermined pitch in a stage direction orthogonal to a row direction of the fins, a distance between fin ends at one side in the stage direction of the fins and a center in a thickness direction of the flat tubes is $k \cdot Dp$ and a distance between fin ends at the other end in the stage direction of the fins and the center in the thickness direction of the flat tubes is $(1-k) \cdot Dp$, where Dp is a pitch of the flat tubes in the stage direction and k is a coefficient of Dp, and either $0<k<0.5$ or $0.5<k<1$, an odd-numbered one of the single-row flat tube heat exchangers is disposed in opposite orientation with respect to the stage direction to an even-numbered one of the single-row flat tube heat exchangers with regard to an air flow direction, upper and lower ends of the odd-numbered one of the single-row flat tube heat exchangers are aligned with upper and lower ends of the even-numbered one of the single-row flat tube heat exchangers, the fins are arranged orthogonally to the flat tubes, and the one end of each of the fins that is provided with the insertion portions, and one end of each of the flat tubes that is positioned at a shallow side with respect to each of the insertion portions, are aligned with each other.

7. The flat tube heat exchangers of claim 6, wherein satisfies one of 0.25 and 0.75.

* * * * *